US005655731A

United States Patent [19]

Schneider et al.

[11] Patent Number: 5,655,731

[45] Date of Patent: *Aug. 12, 1997

[54] HUB FOR HOLDING TAPE IN A WOUND CONFIGURATION

[75] Inventors: Ron Schneider, Imperial Beach; Frederick G. Budde, Jr., El Cajon, both of Calif.; Jose Carlos Figueroa, Tijuana, Mexico

[73] Assignee: Cintas Technologies, Inc., Chula Vista, Calif.

[ * ] Notice: The term of this patent shall not extend beyond the expiration date of Pat. No. 5,476,236.

[21] Appl. No.: 466,389

[22] Filed: Jun. 6, 1995

Related U.S. Application Data

[63] Continuation of Ser. No. 122,018, Sep. 15, 1993, Pat. No. 5,476,236.

[51] Int. Cl.[6] ..... B65H 75/10

[52] U.S. Cl. ..... 242/605; 242/611.2; 242/613.5

[58] Field of Search ..... 242/605, 611.2, 242/118.41, 613.5, 610.6; 206/389, 391, 394, 503, 509

[56] References Cited

U.S. PATENT DOCUMENTS

| | | | |
|---|---|---|---|
| 4,081,151 | 3/1978 | Ender | 242/605 |
| 4,162,047 | 7/1979 | Hashimoto | 242/613.5 |
| 4,280,670 | 7/1981 | Schor | 242/605 |
| 4,340,188 | 7/1982 | Derendorf | 242/605 |
| 4,341,357 | 7/1982 | Filippo | 242/605 |
| 5,169,086 | 12/1992 | Vesely | 242/605 |

*Primary Examiner*—John M. Jillions

*Attorney, Agent, or Firm*—Ellsworth R. Roston; Charles H. Schwartz

[57] ABSTRACT

A peripheral portion in a hub is hollow, flat and defined by a pair of spaced and parallel surfaces. An annular periphery in this portion holds a tape in a wound configuration. An additional portion integral with the inner periphery of the peripheral portion has undulations each disposed radially. The undulations extend progressively in an annular direction. Preferably the undulations are in the form of corrugations each having oppositely disposed segments. Preferably each corrugation segment has the same angle as the other segment in such corrugation, this angle preferably being approximately 47° C. Preferably the additional portion has first and second surfaces shaped to define the corrugations. Preferably the first surface of the additional portion is alternately substantially flush with one flat surface of the peripheral portion and then is spaced outwardly in a first axial direction from the other flat surface of the peripheral portion. Preferably the second surface of the additional portion is alternately substantially flush with the other flat surface of the peripheral portion and then is spaced outwardly in an opposite axial direction from the one flat surface of the peripheral portion. Preferably the extremity of each corrugation is flat and substantially parallel to the flat surfaces of the peripheral portion. The additional portion is hollow at its radial interior. Recesses extend radially into the additional portion from the hollow interior at spaced annular intervals to receive pins in a driving member. The hubs thus nest when stacked and occupy a minimal space.

34 Claims, 1 Drawing Sheet

HUB FOR HOLDING TAPE IN A WOUND CONFIGURATION

This is a continuation of application Ser. No. 08/122,018, filed Sep. 15, 1993, now U.S. Pat. No. 5,476,236.

This invention relates to a hub for holding a tape in a wound configuration on its external periphery. More particularly, the invention relates to a hub which is relatively simple in construction and yet is stronger than the hubs of the prior art and which nests in a stacked relation with other hubs of the same construction.

Magnetic tapes are used extensively to store and reproduce magnetically recorded audio information. For example, most automobiles have a reproducer for playing back music or lectures recorded on tape. While the passengers in the automobile travel between one destination and another, such as between the home and the office, the passengers can accordingly be entertained or educated.

The magnetic tapes are generally wound on an annular peripheral surface of a hub which may be constructed in a hollow disc-shaped form. The hub is generally provided with a winding surface at its outer radial end to hold the tape in a wound configuration on its external annular periphery. The hub is generally provided with a configuration radially interior to the winding surface such that the hubs will nest when stacked. In this way, the hubs can be disposed in a minimal space when stacked and can be shipped in this nested relationship from the manufacturer to the customer. The hubs can be shipped either with or without a tape wound on the hub.

Various types of hubs providing a nesting relationship, when stacked, have been produced in the prior art. However, these hubs have had certain disadvantages. One disadvantage is that the hubs have been relatively complicated in construction. Another disadvantage has been that a relatively low force inadvertently applied to the hubs in a radial direction from a position external to the periphery of the hubs has tended to separate the hubs from a nested relationship when the hubs have been stacked in the nested relationship. A further disadvantage has been that the hubs tend to buckle from the radial force produced on the peripheries of the hubs by the tension of the tapes wound on the hubs, particularly since these tapes may be as long as approximately three (3) miles if extended in an unwound configuration.

This invention provides a hub which overcomes the disadvantages specified above. The hub of this invention is relatively simple in construction. It can be made from a minimum amount of material to minimize costs. It can be produced relatively efficiently and inexpensively. It does not become unstacked easily from a nested relationship even when subjected inadvertently to a radial force from a position external to the hub. It is able to withstand the tension of the tape on the hub without buckling even when the tape has an unwound length as long as approximately three (3) miles.

In one embodiment of the invention, a peripheral portion in a hub is hollow, flat and defined by a pair of spaced and parallel surfaces. An annular periphery in this portion holds a tape in a wound configuration. An additional portion is integral with the inner periphery of the peripheral portion. The additional portion has undulations each disposed radially. The undulations extend progressively in an annular direction. Preferably the undulations are in the form of corrugations each having oppositely disposed segments. Preferably each segment in each corrugation has the same angle as the other segment in such corrugation, this angle preferably being 47° C.

Preferably the additional portion has first and second surfaces shaped to define the corrugations. Preferably the first surface of the additional portion is alternately substantially flush with one flat surface of the peripheral portion and then is spaced outwardly in a first axial direction from the other flat surface of the peripheral portion. Preferably, the second surface of the additional portion is alternately substantially flush with the other flat surface of the peripheral portion and then is spaced outwardly in an opposite axial direction from the one flat surface of the peripheral portion.

Preferably the extremity of each corrugation is flat and substantially parallel to the flat surfaces of the peripheral portion. The additional portion is hollow at its radial interior. Recesses extend radially into the additional portion from the hollow interior at spaced annular intervals to receive pins in a driving member. The hubs thus nest when stacked and occupy a minimal space.

In one embodiment of the invention, a hub generally indicated at 10 may be provided. The hub 10 may be made from a suitable material such as a thermosetting plastic preferably having electrically insulating properties. The hub 10 includes a peripheral portion 12 having a flat pancake configuration with a pair of spaced flat and parallel surfaces 14 and 16. The distance between the surfaces 14 and 16 may be a value which equals the product width to be wound on the hub, such as approximately one hundred and fifty thousands of an inch (0.150").

Figure 6:
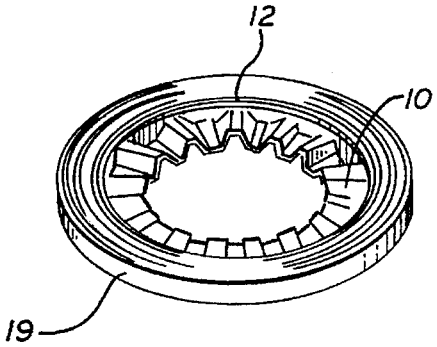
FIG. 6 is a perspective view of the hub and schematically illustrates a tape wound on the hub.

The peripheral portion 12 has an outer peripheral surface 18 which may have an annular configuration. The radial distance between the outer peripheral surface 18 and the inner diameter of the peripheral portion 12 may be approximately one tenth of an inch (0.1"). The outer diameter of the peripheral portion 12 may be approximately four and one half inches (4.5"). A tape 19 (FIG. 6) may be wound on the annular peripheral surface 18 of the peripheral portion 12. As the word "tape" is used in the specification and the claims, it is intended to include any strip or ribbon.

An additional portion 20 may be integral at its radially outer end with the radially inner end of the peripheral portion 12. The additional portion 20 may be formed from a plurality of undulations generally indicated at 22. Each of the undulations 22 may be defined by a pair of segments 24 and 26 each of which has a suitable angle such as approximately 47° C. with the flat surfaces 14 and 16. Preferably, fifteen (15) undulations 22 extend around the annular periphery of the peripheral portion 12. A surface such as that indicated at 28 extends radially inwardly from the inner surface of the peripheral portion 12 at a suitable angle such as approximately 45° C. and joins the segments 24 and 26 of each undulation.

Preferably, the undulations 22 are in the form of corrugations in which each of the corrugations is defined by the segments 24 and 26. The corrugations have first and second surfaces 30 and 32 which are separated from each other by a suitable thickness such as approximately one tenth of an inch (0.100"). In defining the corrugations, the surface 30 is alternately substantially flush with the surface 14 and is then spaced axially outwardly from the surface 16 by a distance of approximately one tenth of an inch (0.1") corresponding to the thickness of the corrugations. In like manner, the surface 32 is alternately substantially flush with the surface 16 and is then spaced axially outwardly from the surface 14, in a direction opposite to the direction of the surface 30, by the distance of approximately one tenth of an inch (0.1"). In this way, the total axial thickness of the hub 10 may be approximately three hundred and fifty thousandths of an inch (0.350").

The surfaces 30 and 32 are flattened in a radial direction at their axial extremities as respectively indicated at 40 and 42. The width of each of these flattened surfaces 40 and 42 may be approximately 0.1366". The flattened surfaces 40 and 42 may be substantially parallel to the surfaces 14 and 16 of the peripheral portion 12. By flattening the corrugations to provide the flattened surfaces 40 and 42, the axial width of the hub 10 may be significantly decreased and the nesting of the hubs 10 in the stacked relationship may be facilitated.

The additional portion 20 may be hollow at its center as indicated at 44. The diameter of the hollow periphery of the additional portion 20 may be approximately three inches (3.0"). Recesses 46 may be provided at equally spaced annular distances around the hollow inner periphery 44 of the additional portion 20. For example, six recesses 46 may be formed at equally spaced annular distances around the inner periphery 44 of the additional portion 40. Each of the recesses 46 may be provided with a suitable diameter such as approximately 0.234". Alternate ones of the recesses 46 may be formed at the flattened surfaces 40 and the other ones of the recesses 46 may be formed at the flattened surfaces 42. Pins or keys of a driving member (not shown) may be disposed in the recesses 46 to hold the hub 12 in a locked relationship with the winding member during the winding of the product.

Figure 1:
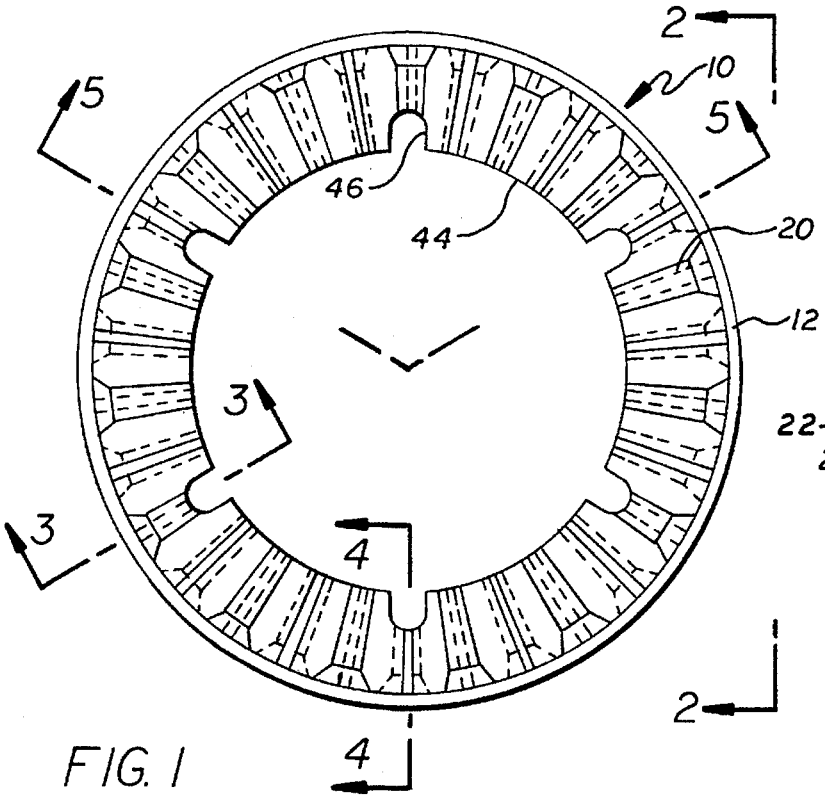
FIG. 1 is a plan view of a hub constituting one embodiment of the invention.
Figure 2:
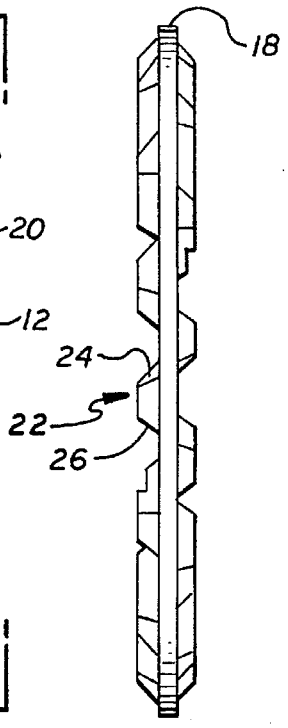
FIG. 2 is a sectional view of the hub shown in FIG. 1 and is taken substantially on the line 2—2 of FIG. 1.
Figure 3:
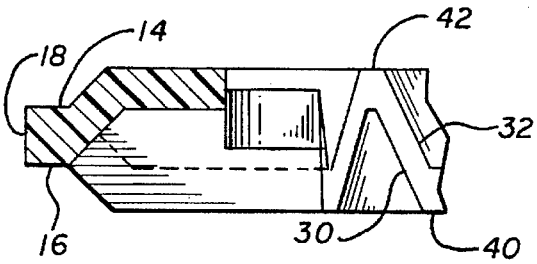
FIG. 3 is an enlarged fragmentary sectional view of the hub and is taken substantially on the line 3—3 of FIG. 1.
Figure 4:
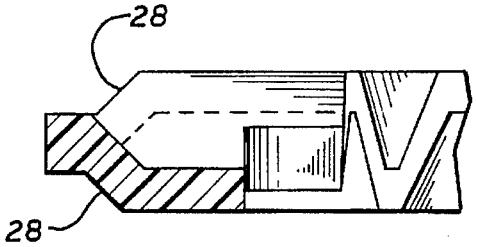
FIG. 4 is an enlarged fragmentary sectional view of the hub and is taken substantially on the line 4—4 of FIG. 1.
Figure 5:
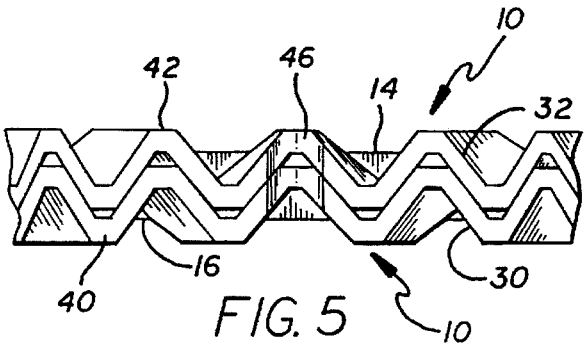
FIG. 5 is an enlarged fragmentary sectional view of a plurality of the hubs in a stacked, or nested, relationship and is taken substantially on the line 5—5 of FIG. 1.

FIG. 5 illustrates how the hubs 10 may be stacked in a nested relationship. As shown, the segments 24 and 26 in each hub 10 nest inside the cavity defined by the segments 24 and 26 of the contiguous hub. This minimizes the space occupied by the hubs when the hubs are stacked in the nested relationship. In this nested relationship, the hubs are able to withstand forces inadvertently exerted on the hubs in a direction (e.g. radial) to separate the hubs from the nested relationship. Furthermore, the hubs are able to withstand the force exerted by the tape on the hubs in the radial direction after the hubs have been individually removed from the nested relationship and the tapes have been wound on the hubs. This is true even when the tapes have an unwound length of approximately one (1) mile.

As previously indicated, the peripheral portion 12 has a radial dimension which is relatively short compared to the radial dimension of the additional portion 20. This enhances the ability of the hub 10 to withstand the force exerted by the tape on the hub in the radial direction after the hub has been removed from the nested relationship and the tape has been wound on the hub. It also enhances the ability of the hubs to remain stacked in the nested relationship.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. A hub for holding tape in a wound configuration, including:

a peripheral portion having an annular configuration and defining an outer annular periphery of the hub and an inner annular periphery, the peripheral portion having an annular outer peripheral surface for receiving the tape in the wound configuration and having an inner peripheral surface, and an additional portion having a hollow center and disposed radially inwardly of the inner peripheral surface of the peripheral portion and having an undulating configuration alternately extending axially above and below the peripheral portion with progressive positions in the annular direction and having a substantially constant axial disposition extending radially at each individual position in the annular direction from the inner annular periphery of the peripheral portion to the hollow center of the additional portion.

2. A hub assembly as set forth in claim 1 wherein the peripheral portion has a pair of spaced and parallel surfaces defining a thickness for the peripheral portion and wherein the additional portion is integral with the peripheral portion at every position around the inner annular periphery of the peripheral portion.

3. A hub assembly as set forth in claim 2 wherein the undulations in the additional portion extend axially at acute angles relative to the spaced and parallel annular surfaces of the peripheral portion along the full radial distance of the additional portion at progressive position in the annular direction.

4. A hub assembly as set forth in claim 3 wherein the acute angle of alternate ones of the annular undulations is alternately approximately 47° C. in one annular direction, and the acute angle of the other ones of the annular undulations is approximately 47° C. in an opposite annular direction, relative to the spaced and parallel annular surfaces of the peripheral portion along the full radial distance of the additional portion.

5. A hub as set forth in claim 3, including, a tape wound on the annular peripheral surface of the peripheral portion and the undulations having substantially a V shape along the full radial distance of the additional portion.

6. A hub for holding a tape in a wound configuration, including, a hollow portion having an annular configuration and having an annular peripheral surface disposed radially outwardly on the first hollow portion to receive the tape and having an annular inner peripheral surface defining the radially inward boundary of the hollow portion, and a portion disposed radially inwardly from the hollow portion in integral relationship with the hollow portion at the radially inward end of the hollow portion at every annular position on the inner peripheral surface defining the radially inward boundary of the hollow portion, the radially inward portion alternately extending to one axial side and then to the other axial side of the hollow portion with progressive annular positions along such portion, the alternate extensions being integral with one another, the alternate integral axial extension of the radially inward portion at the progressive annular positions being in a single plane along their complete radial length and having a substantially V shape in the annular direction along the full radial distance of the alternate axial extensions of the radially inward portion.

7. A hub as set forth in claim 6, including, the alternate integral axial extensions of the radially inwardly disposed portion being at acute angles at progressive annular positions relative to the hollow portion and having a hollow configuration defined by an inwardly disposed surface, and recesses disposed at spaced positions in the inwardly disposed surface of the radially inwardly disposed portion and extending only partially along the radial distance of the radially inwardly disposed portion.

8. A hub as set forth in claim 7, including, a tape wound on the peripheral surface of the hollow portion.

9. A hub for holding a tape in a wound configuration, including, a hollow portion having an annular configuration and having a peripheral surface disposed radially outwardly on the first hollow portion to receive the tape and having an inner peripheral surface defining the radially inward boundary of the hollow portion, and a portion disposed radially inwardly from the hollow portion in integral relationship with the hollow portion at the radially inward end of the hollow portion at every position on the inner peripheral surface defining the radially inward boundary of the hollow portion, the radially inward portion alternately extending to one axial side and then to the other axial side of the hollow portion with progressive annular positions along such portion, the alternate extensions of the radially inward portion being at angles of substantially 47° C. in the annular direction relative to the hollow portion.

10. A hub for holding a tape in a wound configuration, including, a hollow annular portion having an inner annular periphery and annular outer periphery for receiving the tape in the wound configuration on such outer annular periphery and having a pair of flat parallel surfaces extending radially inwardly from the outer annular periphery to the inner annular periphery in spaced relationship to each other, and an additional portion extending radially inwardly from the inner annular periphery of the annular portion and having a hollow configuration defined by an inner annular surface and, for each annular position, having the same axial disposition at every position in the radial direction between the inner annular periphery of the hollow annular portion and the inner annular surface of the additional portion.

11. A hub as set forth in claim 10, including, the hollow annular portion and the additional portion being integral at every annular position, and the additional portion being hollow.

12. In combination, a hub having a peripheral portion and an additional portion integral with the peripheral portion, the additional portion being disposed radially interior to the peripheral portion, the peripheral portion having axially flat and substantially parallel surfaces and defining an outer annular periphery, the additional portion having a corrugated configuration extending axially outwardly beyond the flat surfaces of the peripheral portion along the full radial distance of the additional portion through substantially equal axial distances in opposite axial directions, the corrugated configuration being the same along the full radial distance of the additional portion at each progressive annular position of the additional portion.

13. In a combination as set forth in claim 12, a tape wound on the outer annular periphery of the peripheral portion.

14. In a combination as set forth in claim 13, the peripheral portion and the additional portion being annular, the corrugated configuration being defined by corrugations extending alternately in first and second opposite annular directions along the full radial distance of the additional portion at each progressive annular position and defining substantially equal angles with the flat parallel surfaces of the peripheral portion in the first and second opposite annular directions, and the additional portion having a hollow interior.

15. In a combination as set forth in claim 12, the corrugated configuration being defined by corrugations axially flat along the full radial distance of the additional portion, the flat axial extremities being substantially parallel to the flat surfaces of the peripheral portion.

16. In a combination as set forth in claim 15, the corrugations extending alternately in first and second opposite axial directions and defining substantially equal angles relative to the flat surfaces of the peripheral portion in the first and second opposite axial directions along the full radial distance of the additional portion, the additional portion having a hollow interior, and alternate ones of the corrugations being substantially flush with one of the flat surfaces of the peripheral portion and extending outwardly beyond the other flat surface of the peripheral portion and the other ones of the corrugations being substantially flush with the other flat surface of the peripheral portion and extending outwardly beyond the one flat surface of the peripheral portion.

17. In a combination as set forth in claim 16, the hollow interior of the additional portion being defined by an annular peripheral surface, and there being recesses extending radially into the additional portion at spaced annular positions from the annular peripheral surface at the hollow interior of the additional portion, the recesses extending only a partial radial distance from the hollow interior of the additional portion to the integral relationship between the peripheral portion and the additional portion.

18. A hub for holding a tape in a wound configuration, including, a hollow peripheral portion having a smooth annular periphery for receiving the tape in the wound configuration and having a pair of flat parallel surfaces extending radially inwardly from the annular periphery in spaced relationship to each other and terminating at an inner periphery, and an additional portion extending radially inwardly from the inner periphery of the hollow peripheral portion and having a hollow center and extensions in the axial direction beyond the flat parallel surfaces, each of the extensions being disposed in the radial direction through a distance substantially from the hollow peripheral portion to the hollow center in the additional portion, alternate ones of the extensions extending in the axial direction from a position flush with one of the flat parallel surfaces in the pair to a position beyond the other flat parallel surface in the pair and the other ones of the extensions extending in the axial direction from a position flush with the other one of the flat parallel surfaces in the pair to the one flat parallel surface in the pair.

19. A hub as set forth in claim 18, including, the radial distance of the additional portion being greater than the radial distance of the hollow peripheral portion.

20. A hub as set forth in claim 18, including, the additional portion between the hollow peripheral portion and the hollow center being substantially the same in the axial direction at the progressive positions in the radial direction from the inner periphery of the hollow peripheral portion to the hollow center of the additional portion for each individual position of the additional portion in the annular direction.

21. A hub as set forth in claim 19, including, the hollow peripheral portion and the additional portion having annular peripheries, the alternate extensions in the additional portion beyond the flat parallel surfaces of the hollow peripheral portion in the axial direction being provided at every position around the annular periphery of the additional portion and being provided with the same axial disposition at the progressive positions in the radial direction from the inner periphery of the hollow peripheral portion to the hollow center in the additional portion for each individual position of the additional portion in the annular direction.

22. A hub as set forth in claim 18, including, the radial distance of the additional portion being greater than the radial distance of the hollow peripheral portion, the additional portion being substantially the same in the axial direction between the hollow peripheral portion and the hollow center at the progressive positions in the radial direction from the inner periphery of the hollow peripheral portion to the hollow center in the additional portion for each individual position of the additional portion in the annular direction, and recesses disposed at spaced positions in the additional portion and extending only a portion of the radial distance of the additional portion from the hollow center of the additional portion to the inner periphery of the peripheral portion.

23. A first hub for holding tape in a wound configuration, including:

a peripheral portion defining an outer periphery and a hollow inner periphery, and an additional portion integral with the peripheral portion at the hollow inner periphery of the peripheral portion and having a hollow inner periphery and defining a locking relationship at every position in the additional portion with every position in an additional portion of a second hub having the same construction as the first hub, the additional portions of the first and second hubs defining the locking relationship when the additional portions of the first and second hubs are in a nesting relationship, the additional portion of the first hub being axially unchanged at successive positions in the radial direction on each progressive radial line displaced in an annular direction from other radial lines and extending radially inwardly between the inner periphery of the peripheral portion and the hollow inner periphery of the additional portion.

24. A first hub as set forth in claim 23 wherein recesses are provided in the hollow inner periphery of the additional portion of the first hub to receive pins of a driving member for holding the hub in a locked relationship during the rotation of the hub, the recesses extending only a portion of the radial distance of the additional portion of the first hub from the inner periphery of the peripheral portion to the hollow inner periphery of the additional portion.

25. A first hub as set forth in claim 23 wherein a tape is wound on the outer annular periphery of the first hub.

26. A first hub as set forth in claim 23 wherein the additional portion of the first hub is symmetrically shaped in the axial direction along the full distance between the hollow inner periphery of the peripheral portion and the hollow inner periphery of the additional portion at progressive positions in an annular direction.

27. A first hub as set forth in claim 23 wherein the symmetrical shape of the additional portion of the first hub is defined by V-shaped corrugations each extending the full distance between the hollow inner periphery of the peripheral portion and the hollow inner periphery of the additional portion at the progressive positions in the annular direction.

28. In a combination as set forth in claim 23 wherein the additional portion of the first hub is defined by corrugations recursive at progressive abutting positions in an annular direction and extending along the full distance between the hollow inner peripheries of the peripheral portion and the additional portion at the progressive positions in the annular direction.

29. A first hub as set forth in claim 28 wherein each of the recursive corrugations has substantially a V-shape in the axial direction at the progressive positions in the annular direction for the full radial distance between the hollow inner periphery of the peripheral portion and the hollow inner periphery of the additional portion.

30. A first hub as set forth in claim 29 wherein a tape is wound on the outer annular periphery of the first hub.

31. A first hub as set forth in claim 30 wherein recesses are provided in the hollow inner periphery of the additional portion along only a portion of the radial distance of the additional portion between the hollow inner peripheries of the peripheral portion and the additional portion to receive pins of a driving member for holding the hub in a locked relationship during the rotation of the hub.

32. A pair of hubs disposable in a nested relationship and having identical constructions, including, a peripheral portion on each of the hubs, the peripheral portion on each of the hubs having an annular inner peripheral surface and an annular outer peripheral surface, an additional portion on each of the hubs in integral relationship with the peripheral portion of such hub at the inner peripheral surface of such peripheral portion at every annular position on the peripheral portion of such hub, the additional portion on each of the hubs being in interlocking relationship with the additional portion of the other hub at substantially every position on the surfaces of such additional portions when the additional portions have a nesting relationship, there being a plurality of recursions in an annular direction on the additional portion in an integral relationship with one another, each of the recursions extending in an axial direction, the additional portion on each of the hubs has a hollow inner periphery and wherein the recursions on the additional portion on each of the hubs are defined by a plurality of corrugations progressively disposed in the axial direction at successive annular positions and extending the full radial distance between the inner peripheral surface of the peripheral portion in such hub and the hollow inner periphery of the additional portion in such hub, the corrugations defining the surface of such additional portion and providing a nesting relationship with the corrugations in the other one of the additional portions.

33. A pair of hubs as set forth in claim 32 wherein the peripheral portion on each of the hubs is provided with a pair of flat surfaces and wherein a pair of tapes is provided each disposed on the outer peripheral surface of the peripheral portion on an individual one of the hubs and wherein the peripheral portion on each of the hubs is provided with a pair of flat surfaces and alternate ones of the corrugations on each of the hubs are substantially flush with one of the flat surfaces on the peripheral portion of such hub and extend axially beyond the other flat surface on the peripheral portion of such hub and the other ones of the corrugations are substantially flush with the other flat surface on the peripheral portion of such hub and extend axially beyond the one flat surface on the peripheral portion of such hub.

34. A pair of hubs as set forth in claim 33 wherein the additional portion has a hollow inner periphery and wherein the corrugations on each additional portion define an acute angle in one annular direction with the flat and parallel surfaces of the peripheral portion with progressive annular positions in such one annular direction, and then an acute angle with the flat and parallel surfaces of such peripheral portion in the other annular direction with progressive positions in such one annular direction, at every position along the distance between the inner peripheral surface of the peripheral portion and the hollow inner periphery of the additional portion.

* * * * *